US009017224B1

(12) United States Patent
Singley

(10) Patent No.: US 9,017,224 B1
(45) Date of Patent: Apr. 28, 2015

(54) LADDER EXERCISER

(71) Applicant: Paul E. Singley, Middleboro, MA (US)

(72) Inventor: Paul E. Singley, Middleboro, MA (US)

( * ) Notice: Subject to any disclaimer, the term of this patent is extended or adjusted under 35 U.S.C. 154(b) by 169 days.

(21) Appl. No.: 13/785,890

(22) Filed: Mar. 5, 2013

(51) Int. Cl.
*A63B 22/04* (2006.01)
*A63B 23/035* (2006.01)

(52) U.S. Cl.
CPC ..... *A63B 23/03575* (2013.01)

(58) Field of Classification Search
USPC ..... 482/51–52, 23, 37, 38, 39, 41; 182/43, 182/97
See application file for complete search history.

(56) References Cited

U.S. PATENT DOCUMENTS

| | | | | |
|---|---|---|---|---|
| 2,042,764 | A | 6/1936 | Birch | |
| 3,381,958 | A | 5/1968 | Gulland | |
| D292,728 | S | 11/1987 | Wilkinson | |
| 4,822,029 | A | 4/1989 | Sarno et al. | |
| 4,848,737 | A | 7/1989 | Ehrenfield | |
| 4,923,191 | A | 5/1990 | Persico | |
| 4,958,830 | A | 9/1990 | Huggins et al. | |
| 4,982,952 | A | 1/1991 | Wang | |
| 5,000,441 | A | 3/1991 | Wang | |
| D315,937 | S | 4/1991 | Huggins et al. | |
| 5,007,631 | A | 4/1991 | Wang | |
| D323,008 | S | 1/1992 | Wang | |
| 5,112,043 | A | 5/1992 | Gilfillian, Jr. | |
| 5,125,877 | A | 6/1992 | Brewer | |
| D329,478 | S | 9/1992 | Wang | |
| 5,145,475 | A | 9/1992 | Cares | |
| 5,199,932 | A | 4/1993 | Liao | |
| 5,222,927 | A | 6/1993 | Chang | |
| 5,328,420 | A * | 7/1994 | Allen | 482/52 |
| 5,328,422 | A | 7/1994 | Nichols | |
| 5,352,166 | A * | 10/1994 | Chang | 482/52 |
| D355,228 | S | 2/1995 | Hung | |
| 5,490,818 | A | 2/1996 | Haber et al. | |
| D369,390 | S | 4/1996 | Haber et al. | |
| 5,549,195 | A | 8/1996 | Aulagner et al. | |
| 5,679,100 | A | 10/1997 | Charnitski | |
| 5,803,880 | A | 9/1998 | Allen | |
| 5,919,117 | A | 7/1999 | Thompson et al. | |
| 6,231,482 | B1 | 5/2001 | Thompson | |
| 6,860,836 | B1 | 3/2005 | Wu | |
| 6,929,587 | B2 | 8/2005 | Charnitski | |
| 7,195,582 | B2 | 3/2007 | Wu | |
| 7,357,757 | B2 | 4/2008 | Brown | |
| 7,381,154 | B1 | 6/2008 | Sudeith et al. | |
| 7,572,208 | B2 | 8/2009 | Brewer | |
| 2004/0229732 | A1 | 11/2004 | Wang et al. | |
| 2008/0015090 | A1 | 1/2008 | Brewer | |
| 2011/0166000 | A1* | 7/2011 | Wight | 482/17 |
| 2014/0228177 | A1* | 8/2014 | Brewer et al. | 482/37 |

* cited by examiner

*Primary Examiner* — Loan H Thanh
*Assistant Examiner* — Megan Anderson
(74) *Attorney, Agent, or Firm* — John P. McGonagle

(57) ABSTRACT

An exercise ladder having an adjustable inclination angle is provided. The ladder has rungs which are motor driven, driving the rungs downward at a desired speed as well as providing means for retarding and braking. The inclination tilt of the exercise ladder ranges from a negative to a positive tilt thereby providing a wide range of exercise possibilities.

8 Claims, 4 Drawing Sheets

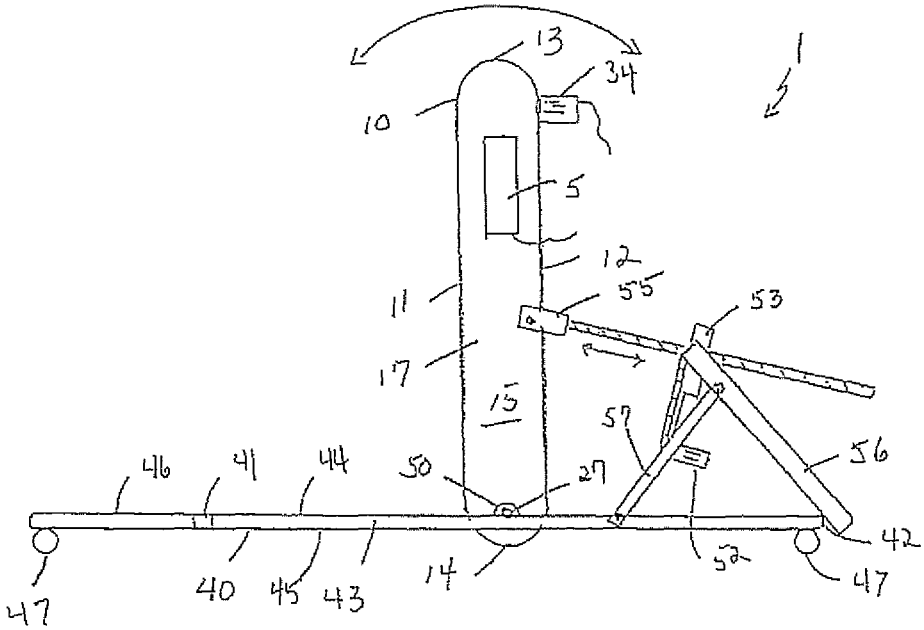
FIG. 1
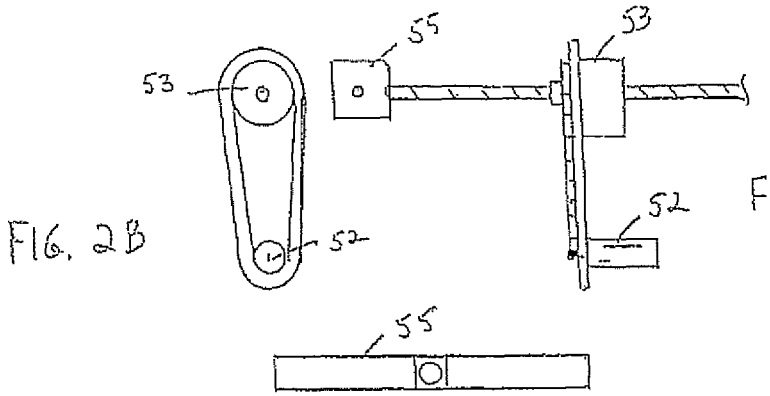
FIG. 2B
FIG. 2A
FIG. 2C

LADDER EXERCISER

CROSS-REFERENCE TO RELATED APPLICATIONS

Applicant claims the priority benefits of U.S. Provisional Patent Application No. 61/613,234, filed Mar. 20, 2012.

BACKGROUND OF THE INVENTION

This invention relates to machine-assisted exercisers, and more particularly to a ladder exerciser for exercising the upper and lower body.

Most prior art exercise machines are designed to provide exercise to the upper body or the lower body. A few machines attempt to provide both, but are limited in the range of exercise provide.

SUMMARY OF THE INVENTION

The present invention overcomes the limitations of prior art by providing an exercise ladder having an adjustable inclination angle. The ladder rungs are motor driven, driving the rungs downward at a desired speed as well as providing means for retarding and braking. The inclination tilt of the exercise ladder ranges from a negative to a positive tilt thereby providing a wide range of exercise possibilities.

These together with other objects of the invention, along with various features of novelty, which characterize the invention, are pointed out with particularity in the claims annexed hereto and forming a part of the disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

FIG. 1 is side view of the invention

FIG. 2A is a side view of the inclination tilt assembly.

FIG. 2B is a front view of the inclination tilt assembly worm gear drive.

FIG. 2C is a rear view of the inclination tilt assembly bracket.

DETAILED DESCRIPTION OF INVENTION

Figure 6:
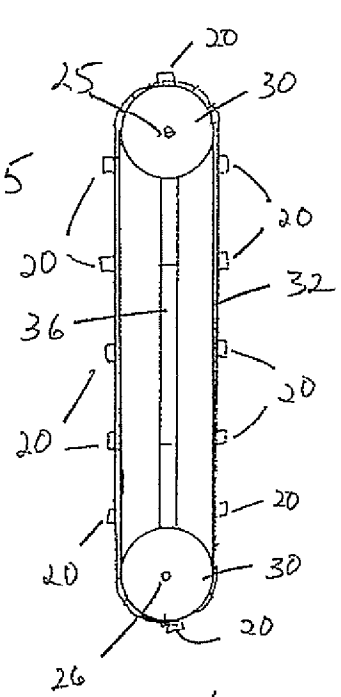
FIG. 6 is a side view of invention the rung assembly.
Figure 5:
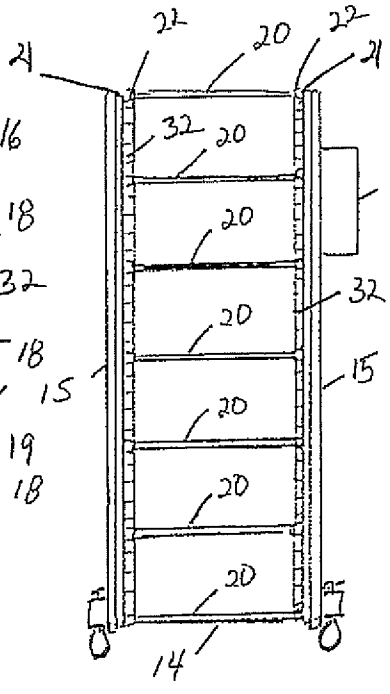
FIG. 5 is a front view of the invention rung assembly.
Figure 4:
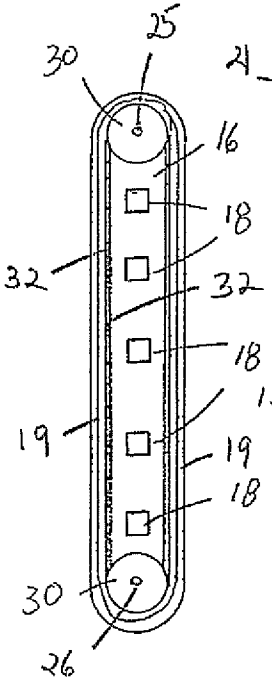
FIG. 4 is a view of a side view inner surface.
Figure 3:
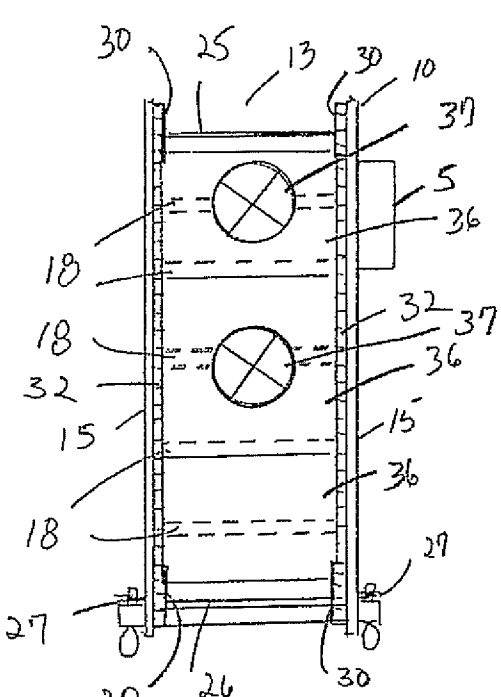
FIG. 3 is a front view of the invention without the rungs.
Figure 7:
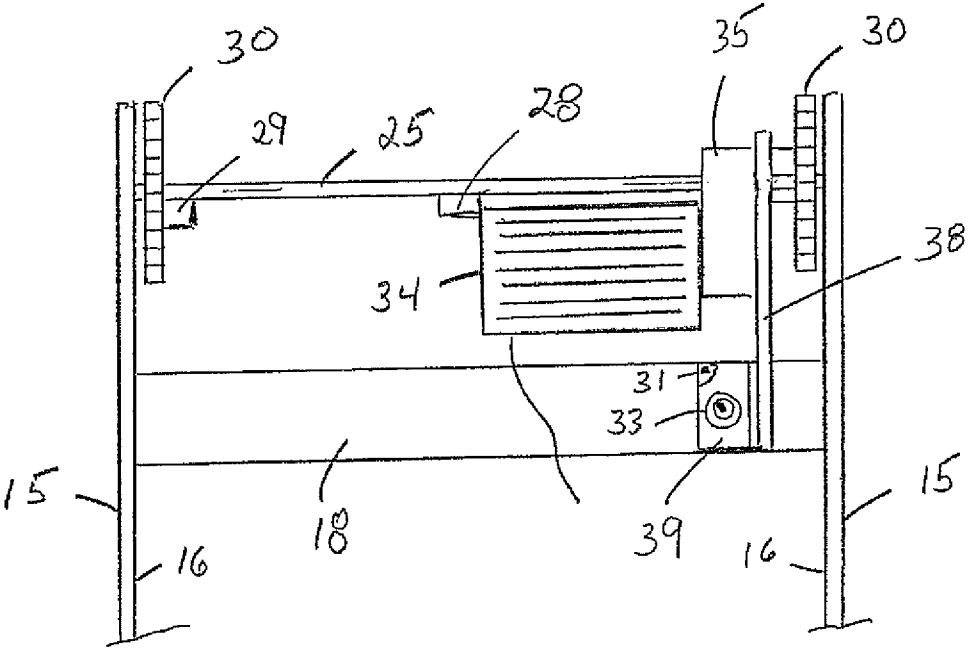
FIG. 7 is a partial upper front view of the invention illustrating the rung drive assembly.
Figure 9:
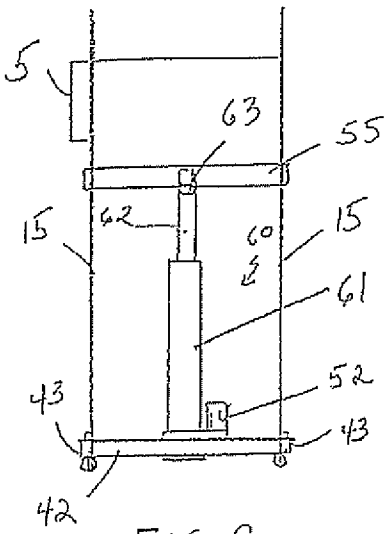
FIG. 9 is a partial rear view illustrating an alternate tilt assembly embodiment.
Figure 8:
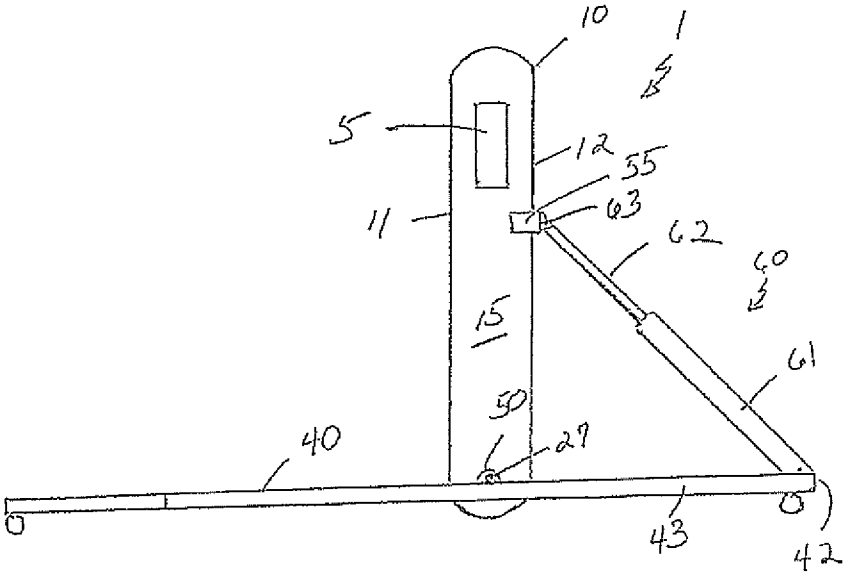
FIG. 8 is a side view of an alternate embodiment of the invention.

Referring to the drawings in detail wherein like elements are indicated by like numerals, there is shown a ladder exerciser 1 constructed according to the principles of the present invention. The ladder exerciser 1 is comprised of a nominally upright frame 10 pivotally attached to a base 40. The frame 10 encompasses a moving ladder assembly. The base 40 includes a frame inclination tilt assembly.

The frame 10 has a front 11, a rear 12, a top portion 13, a bottom portion 14, and two opposite sides 15. Each side 15 has an inner surface 16 and an outer surface 17. The sides 15 are interconnected by a plurality of horizontal brace elements 18 attached to the inner surfaces 16 of each side. The brace elements 18 are attached to the side inner surfaces 16 along a central vertical axis. Each side inner surface 16 has two vertical plastic guiding channels 19 attached thereto, one guiding channel adjacent the frame front 11 and one guiding channel adjacent the frame rear 12. The frame 10 is further comprised of a plurality of rungs 20. Each rung has two opposite ends 21. Each rung end 21 is inserted into a guiding channel 19.

The frame 10 is further comprised of two axles, an upper axle 25 and a lower axle 26. The upper axle 25 extends from one side inner surface to the opposite side inner surface adjacent the frame top portion 13. The lower axle 26 extends to and through each side 15 adjacent the frame bottom portion 14. Each axle 25, 26 has two sprocket wheels 30, one near to each side inner surface 16. The frame 10 is further comprised of two endless, sprocket driving chains 32, each sprocket driving chain fitted about a bottom and top sprocket wheel on a side. Each rung 20 has two attachment elements 22, each attachment element near to a rung end 21. Each rung attachment element 22 is attached to a sprocket driving chain 32. The sprocket driving chains are driven by an electric drive motor 34 with a gear box 35 turning one of the axle shafts 25, 26 and consequently the sprocket wheels. In the embodiments shown, the upper axle 25 is being driven. The electric motor 34 is controlled electronically by a control box 5 to establish speed and to turn the motor on and off.

For safety reasons, there is a first brake 28 on the motor itself, opposite the gear box end of the motor. A second brake 29 is on the upper shaft 25 and is a backup in case the motor or gear train fails. The shaft 25 holds the motor 34 and gear box 35 in position, and wind up torque is taken up by a plate bracket 38 mounted to the side of the gear box 35. On the bottom end of the plate bracket an angle bracket 39 is attached. The angle bracket 39 is attached to the brace element 18 by means of springs 33 (one not shown) on both sides of the angle bracket 39. The springs 33 control "wind up". Because there is a spring 33 on both sides of the angle bracket 39, they counter balance each other to achieve equilibrium. A switch 31 detects the position of the angle bracket 39 and can determine whether or not someone is on the rungs.

Initially, at start-up, the first brake 28 is set on the motor. The rungs are connected to the shaft 25 through the sprocket drive chain 32. Because there is no weight on the rungs, the shaft 25 seeks equilibrium because of the springs 33 on both sides of the angle bracket 39. The switch 31 senses this equilibrium.

When someone mounts the rungs 20, the torque on the shaft 25 moves the plate bracket 38 and the angle bracket 39. The switch 31 senses this. The switch 31 permits the control box 5 to activate the drive motor 34 and release the brake. As long as someone is on the rungs 20, there is torque on the plate bracket 38 and the switch 31 activates the control box 5. If the user dismounts, then the bracket 38 sees equilibrium, deactivates the switch 31, which then brakes and shuts off the motor.

The exercised ladder 1 is further comprised of a base 40. The base has a generally rectangular frame, having a front 41, a rear 42, two opposite sides 43, a top 44 and a bottom 45. Each side 43 has a forwardly extending stabilizer bar 46. The base top 44 has two annular bearing 50, one at each side 43. The ends 27 of the frame lower axle 26 are journaled into each bearing 50. The base bottom 45 may have wheels 47 attached thereto. Said wheels may be attached to the forward tip of each stabilizer bar and the junction of the base rear and each side.

The base rear 42 is further comprised of an inclination tilt assembly comprised of a tilt motor 52 driving a worm gear 53. The worm gear 53 terminates at a brace 55 attached to the frame sides 15. The tilt motor 52 is mounted on two struts 56 attached to the base rear 42. Lateral support bars 57 extend from the base sides 43 terminating in the struts 56 are also provided. The tilt motor 52 is adapted to drive the worm gear forward and backward thereby tilting the frame positively and negatively. The tilt motor 52 is controlled by the control box 5.

In an alternate embodiment, the tilt assembly is comprised of a linear actuator 60 interconnecting the frame 10 with the base rear 42. The linear actuator 60 is comprised of a rotating lead screw (not shown) within a fixed cover 61 rotatably driven by an electric tilt motor 52. The rotating lead screw is attached to a non-rotating lead nut (not shown) attached to a sliding tube 62. As the lead screw rotates the sliding tube 62 moves into and out of the fixed cover depending upon the direction of rotation of the tilt motor 52. The tilt motor is controlled by the control box 5. The distal end 63 of the sliding tube 62 terminates in the brace 55 attached to the frame sides 15. As the sliding tube 62 moves into and out of the fixed cover 61, the frame 10 is tilted forward and rearward a corresponding amount.

The frame 10 preferably has one or more central panels 36 extending from frame top 13 to frame bottom 14, and extending from side to side. The plane of the panel 36 extends from one side inner surfaces central vertical axis to the opposite side inner surface central vertical axis. The central panel 36 may have one or more cooling fans 37 installed thereto.

In operation, the exerciser 1 is initially stopped. The user gets on the exerciser, climbs to a desired height to access the control box 5, and then sets speed and inclination. A start button on the control box 5 is then activated by the user. The exerciser speed and inclination angle may be adjusted while the exerciser is in use. In use the user steps up on the exerciser's lower downwardly moving rungs and pulls himself up by hand on the higher downwardly moving rungs. The exerciser positive inclination places increased strain on the user's lower body and less on the user's upper body. The exerciser's negative inclination places additional strain on the user's arms and upper body and less on the user's lower body. The user's entire body receives a workout with the present invention.

When the user wishes to stop exercising, he turns the exerciser power off at the control box or simply dismounts from the exerciser. When the power is turned off, the driving motor stops and a brake comes on to hold the rungs in place. The exerciser has a sensor which will automatically activate the brake and place the exerciser in a shut down mode when there is no weight on the rungs.

It is understood that the above-described embodiment is merely illustrative of the application. Other embodiments may be readily devised by those skilled in the art which will embody the principles of the invention and fall within the spirit and scope thereof.

I claim:

1. A ladder exerciser, comprising:

a base having a generally rectangular frame with a front, a rear, two opposite sides, a top and a bottom, said base top having two annular bearing, one at each side;

a nominally upright frame pivotally attached to said base, said frame having a front, a rear, a top portion, a bottom portion, and two opposite sides, each frame side having an inner surface and an outer surface, said frame sides being interconnected by a plurality of horizontal brace elements attached to the inner surfaces of each frame side, said brace elements being attached to the frame side inner surfaces along a central vertical axis, each frame side inner surface having two vertical plastic guiding channels attached thereto, one guiding channel adjacent the frame front and one guiding channel adjacent the frame rear, said frame being further comprised of two axles, an upper axle and a lower axle, said upper axle extending from one frame side inner surface to the opposite frame side inner surface adjacent the frame top portion, said lower axle extending to and through each frame side adjacent the frame bottom portion, said lower axle having two opposite ends journaled into each base annular bearing;

a moving ladder assembly encompassed within said frame, said frame having a plurality of rungs, each said rung having two opposite ends, each said rung end being inserted into a frame side guiding channel, each said axle having two sprocket wheels, one near to each frame side inner surface, said moving ladder assembly being comprised of two endless, sprocket driving chains, each said sprocket driving chain fitted about a bottom and top sprocket wheel on the frame side, wherein each rung has two attachment elements, each attachment element being near to a rung end, each said rung attachment element being attached to a sprocket driving chain, wherein said sprocket driving chains are driven by an electric drive motor with a gear box turning one of the axle shafts and consequently the sprocket wheels; and a frame inclination tilt assembly included within said base, and comprised of a linear actuator interconnecting the frame with the base rear, said linear actuator comprised of a rotating lead screw within a fixed cover rotatably driven by an electric tilt motor, said rotating lead screw being attached to a non-rotating lead nut attached to a sliding tube, wherein as the lead screw rotates the sliding tube moves into and out of the fixed cover depending upon the direction of rotation of the tilt motor, wherein the tilt motor is controlled by a control box, wherein the sliding tube has a distal end terminating in a brace attached to the frame sides, wherein as the sliding tube moves into and out of the fixed cover, the frame is tilted forward and rearward a corresponding amount.

2. A ladder exerciser as recited in claim 1, further comprising:

the control box electronically controlling said moving ladder assembly electric drive motor and said tilt motor.

3. A ladder exerciser as recited in claim 2, further comprising:

a plurality of central panels extending from frame top to frame bottom, and extending from frame side to frame side, wherein said panels have planes extending from one frame side inner surface central vertical axis to the opposite frame side inner surface central vertical axis.

4. A ladder exerciser as recited in claim 3, further comprising:

a cooling fan in one of the plurality of central panels.

5. A ladder exerciser as recited in claim 4, wherein:

the electric drive motor and the gear box are held in position by said upper axle, and wind up torque is taken up by a plate bracket mounted on a side of the gear box, wherein an angle bracket is attached to a bottom end of the plate bracket, wherein the angle bracket is attached to a brace element by means of springs on both sides of the angle bracket, said springs counterbalancing each other to control equilibrium, thereby controlling wind up, wherein a switch attached to said brace element detects the position of the angle bracket and is adapted to determine whether or not a user is on the rungs, said switch being electrically connected to said control box.

6. A ladder exerciser as recited in claim 5, further comprising:

a first brake on said electric drive motor, opposite said gear box end of the motor;

a second brake on the upper shaft;

wherein, at start-up, the brakes are set preventing movement of the rungs, wherein as a user mounts the rungs the torque on the upper axle moves the plate bracket and the angle bracket, wherein the switch senses this and signals the control box to activate the electric drive motor and release the brakes;

wherein, if the user dismounts, the bracket sees equilibrium, deactivates the switch, which then signals the control box to set the brakes and shut off the electric drive motor.

7. A ladder exerciser as recited in claim 6, further comprising:

a forwardly extending stabilizer bar on each base side.

8. A ladder exerciser as recited in claim 7, Further comprising:

a plurality of wheels attached to said base bottom and to a forward tip of each stabilizer bar.

* * * * *